313-414 SR
1/19/88 OR 4,720,654

United States Patent [19]
Hernqvist et al.

[11] Patent Number: 4,720,654
[45] Date of Patent: Jan. 19, 1988

[54] MODULAR ELECTRON GUN FOR A CATHODE-RAY TUBE AND METHOD OF MAKING SAME

[75] Inventors: Karl G. Hernqvist, Princeton; Donald C. Pultorak, Hamilton, both of N.J.

[73] Assignee: RCA Corporation, Princeton, N.J.

[21] Appl. No.: 935,390

[22] Filed: Nov. 26, 1986

[51] Int. Cl.[4] ..... H01J 29/50
[52] U.S. Cl. ..... 313/414; 313/417; 313/289; 313/456; 313/451
[58] Field of Search ..... 313/417, 289, 456, 414, 313/451

[56] References Cited

U.S. PATENT DOCUMENTS

| | | | |
|---|---|---|---|
| 2,185,807 | 1/1940 | Garbor et al. | 250/163 |
| 2,740,913 | 4/1956 | Majkrzak | 313/82 |
| 3,201,637 | 8/1965 | Snyder | 313/256 |
| 3,383,537 | 5/1968 | Marshall | 313/82 |
| 3,523,205 | 8/1970 | Oess | 313/85 |
| 3,538,368 | 11/1970 | Oess | 313/82 |
| 4,288,719 | 9/1981 | Hernqvist | 313/457 |
| 4,298,818 | 11/1986 | McCandless | 313/417 |
| 4,341,545 | 7/1982 | Hale | 65/154 |
| 4,350,925 | 9/1982 | Marschka | 313/451 |
| 4,368,403 | 1/1983 | Lewis | 313/457 |
| 4,400,644 | 8/1983 | Hale | 313/256 |
| 4,491,764 | 1/1985 | D'Amato | 315/3 |

*Primary Examiner*—Theodore M. Blum
*Attorney, Agent, or Firm*—Eugene M. Whitacre; Dennis H. Irlbeck; Vincent J. Coughlin, Jr.

[57] ABSTRACT

A novel electron gun for a cathode-ray tube includes at least one and preferably three cathode assemblies and at least four successive electrodes longitudinally spaced from the cathode assemblies. Each of the electrodes has at least one and preferably three electron beam apertures therethrough. The cathode assemblies and two of the electrodes are attached to a ceramic support member which is the sole supporting interconnection therebetween. A third electrode of the four successive electrodes has a distal electrode member and a proximal electrode member. The proximal member also is attached to the ceramic support member to form a first gun module. A second gun module includes a fourth electrode of the four successive electrodes which is in spaced relation to the distal member of the third electrode. The fourth electrode and the distal member of the third electrode are interconnected by a pair of insulative spacers. The second gun module is secured to the first gun module by fixedly attaching the distal member of the second gun module to the proximal member of the first gun module.

7 Claims, 5 Drawing Figures

MODULAR ELECTRON GUN FOR A CATHODE-RAY TUBE AND METHOD OF MAKING SAME

BACKGROUND OF THE INVENTION

The present invention relates to an electron gun assembly for a cathode-ray tube (CRT), and particularly to an electron gun assembly in which two gun modules are fabricated separately and then joined together to form an electron gun.

U.S. Pat. No. 4,400,644 issued to J. R. Hale on Aug. 23, 1983 describes a conventional electron gun such as that shown in FIGS. 1 and 2, fabricated by a single step beading operation in which metal support tabs or claws on each of the electrodes and other elements of the electron gun are embedded into a pair of oppositely disposed glass support beads. The support beads include at least two indexing cavities formed in the outer surface to properly locate the support beads on a beading apparatus such as that described in U.S. Pat. No. 4,341,545 issued to J. R. Hale on July 27, 1982.

A drawback of the conventional beading operation is that there is no chemical bond between the metal tabs or claws and the glass support beads. Anchoring of the various electrodes and other elements relies on entrapping glass between the claws to mechanically secure the electrodes and elements to the glass beads. Additionally, the method of embedding the metal tabs or claws within the support beads can induce misalignment of the electrodes. As described in U.S. Pat. No. 4,341,545, issued to Hale, the support beads are placed on beading blocks and the beads are heated until the glass softens sufficiently to permit the tabs or claws to be embedded therein. Then, the beading blocks are swung toward a mandrel holding the various electrodes and other elements of the electron gun. The molten support beads contact the metal tabs or claws which penetrate the support beads. Thermal and mechanical shock during the beading operation and the subsequent cooling may act to misalign or distort the various electrodes.

U.S. Pat. No. 4,298,818 issued to H. E. McCandless on Nov. 3, 1981 describes an improved electron gun in which a plurality of cathode assemblies, a control grid electrode (G1) and a screen grid electrode (G2) are all individually attached to a single ceramic member to form a beam-forming region (BFR) sub-assembly which is then attached, for example by welding, to a support bracket which was previously beaded, along with a main electron lens assembly, into a pair of glass support beads. The advantage of the patented structure is that the control grid and screen grid electrodes can be very accurately aligned and attached to the ceramic member, for example by brazing. A drawback of the patented structure is that the accuracy with which the support bracket and the main electron lens can be attached to the glass support beads is not substantially improved since a conventional beading apparatus is used to embed these elements into the support beads.

A further problem with a conventional electron gun structure is that electrical flashover (arcing) sometimes occurs from the lower end of the gun to a high voltage electrode (G4). The arcing occurs in the channels formed between the support beads and the neck of the tube envelope. U.S. Pat. No. 4,288,719 issued to K. G. Hernqvist on Sept. 8, 1981 discloses providing a conductive area on the surface of the support beads facing the neck in the vicinity of a focusing electrode (G3).

The conductive area has the effect of neutralizing the longitudinal electric field in the channel, thereby reducing the longitudinal current in the channel, at least to the point where arcing is suppressed substantially. While the structural and arc suppressing improvements described in the aforementioned patents of Hale, McCandless, and Hernqvist have improved the manufacturability, alignment and performance of electron guns, further improvements are necessary in order to reduce the cost of the cathode-ray tube and improve its reliability and performance.

SUMMARY OF THE INVENTION

A novel electron gun for a cathode-ray tube includes at least one cathode assembly and at least four successive electrodes longitudinally spaced from the cathode assembly. Each of the electrodes has at least one electron beam aperture therethrough. The electron gun comprises a first gun module having a cathode assembly and two of the electrodes are attached to a ceramic support member which is the sole supporting interconnection therebetween. A third electrode of the four successive electrodes has a distal electrode member and a proximal electrode member, the proximal member also is attached to the ceramic support member of the first gun module. A second gun module includes a fourth electrode of the four successive electrodes which is in spaced relationship to the distal member of the third electrode. The fourth electrode and the distal member of the third electrode are interconnected by insulative support means. The distal member of the second gun module is joined to the proximal member of the first gun module to form the electron gun.

DETAILED DESCRIPTION OF THE PREFERRED EMBODIMENTS

Figure 2:
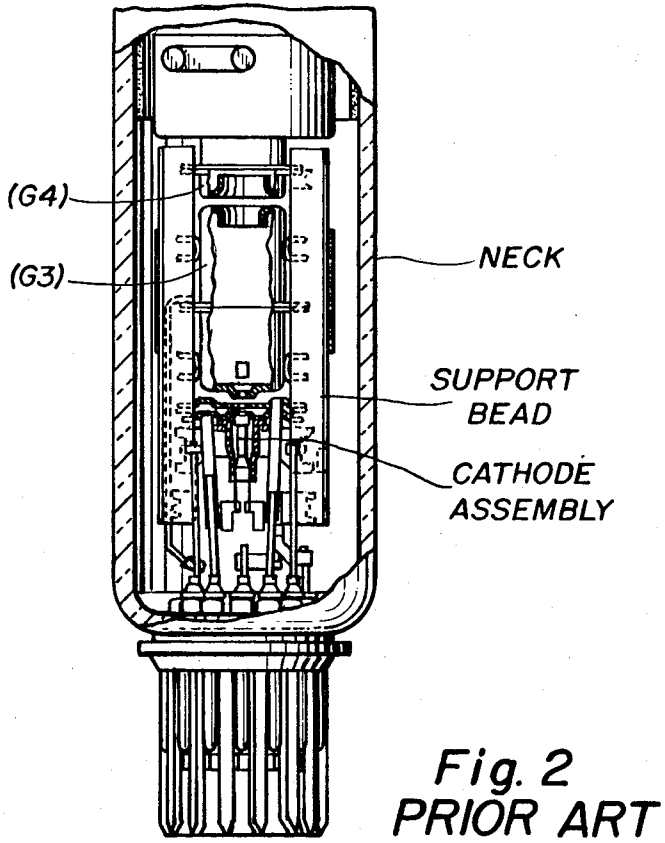
Fig. 2 PRIOR ART
FIG. 2 shows a side view, partially in section, of the electron gun within the neck of the CRT shown in FIG. 1.
Figure 1:
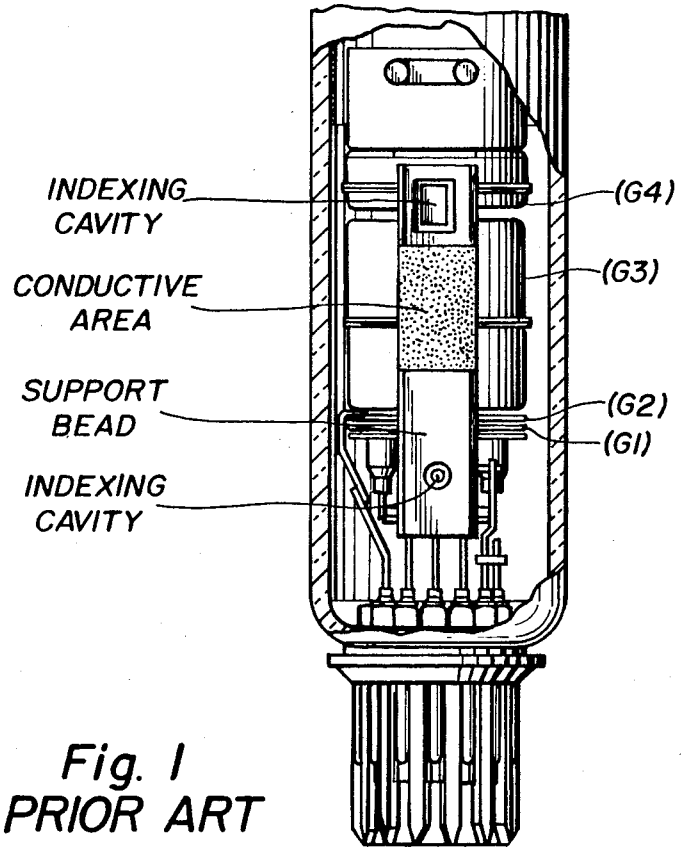
Fig. 1 PRIOR ART
FIG. 1 shows a broken-away front elevational view of a conventional electron gun within the neck of a CRT.
Figure 3:
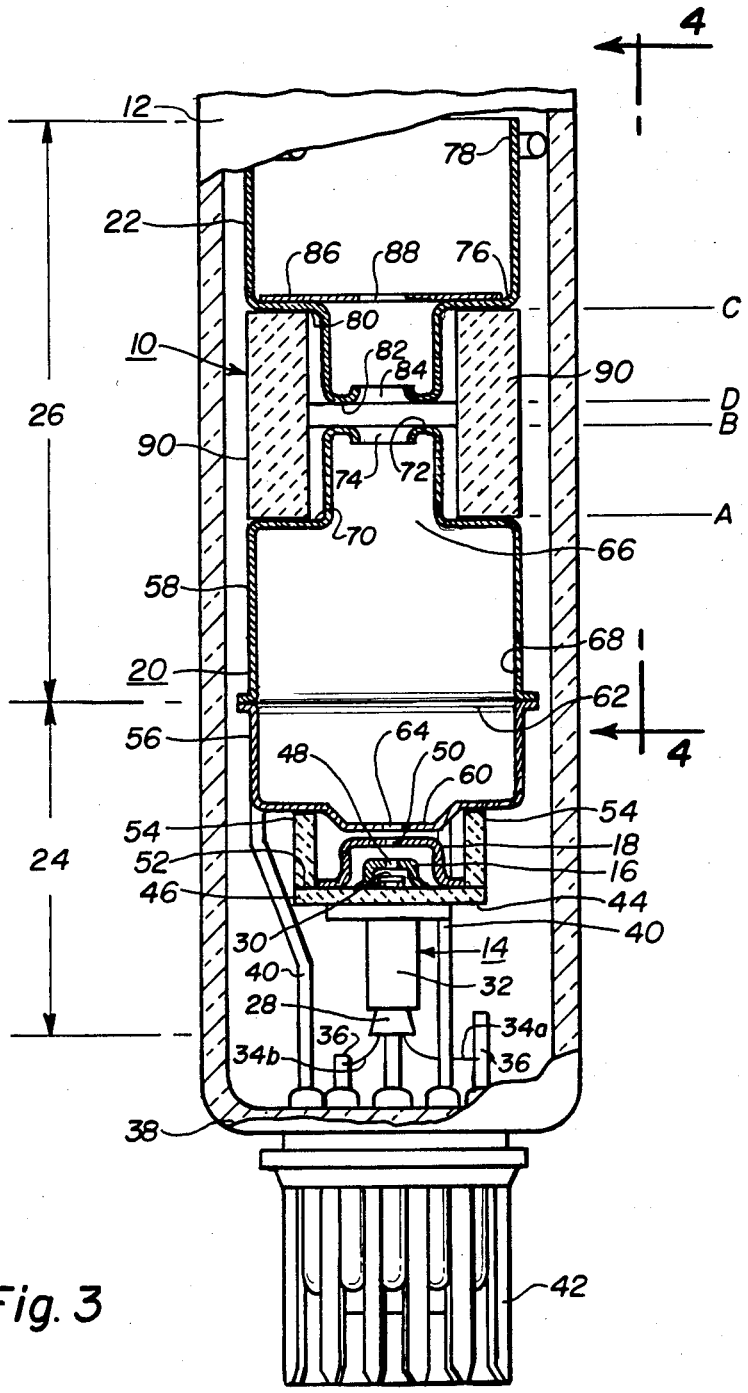
FIG. 3 shows a side view, partially in section, of a novel electron gun according to the present invention within the neck of a CRT.

As shown in FIG. 3, an improved electron gun 10 is disposed within the neck portion of a CRT envelope 12. The electron gun 10 comprises three inline cathode assemblies 14 (only one of which is shown) and a plurality of successive electrodes including a control grid electrode 16, a screen grid electrode 18, a first focusing and accelerating electrode 20, and a second focusing and accelerating electrode 22 which are longitudinally spaced, in the order named, from the cathode assemblies 14. Unlike prior electron guns, the improved electron gun 10 comprises a first gun module 24 and a second gun module 26 which are separately manufactured as described hereinafter and affixed together to form the electron gun.

The first gun module 24 is similar to the structure described in U.S. Pat. No. 4,298,818, referenced herein, which is assigned to the assignee of the present invention, and is incorporated by reference herein for the purpose of disclosure. Each of the cathode assemblies 14 comprises a substantially cylindrical cathode sleeve 28 closed at the forward end and having an electron emissive coating 30 thereon. The cathode sleeve 28 is supported at its open end within a cathode eyelet 32. A heater (not shown) is positioned within the sleeve 28, in order to indirectly heat the electron emissive coating 30. The heater coil has a pair of heater legs 34*a* and 34*b* which are attached, for example by welding, to a pair of stem leads 36 which extend through a stem 38 sealed to the neck portion of the envelope 12. In addition to the stem leads 36, a plurality of other stem leads 40 (only some of which are shown) make internal electrical contact to different ones of the tube electrodes and extend through the stem 38. A pin protector base 42 supports the stem leads 36 and 40, as is known in the art. The cathode assemblies 14 are attached, for example by brazing, to a first major surface 44 of a ceramic support member 46. The control grid electrode 16 and the screen grid electrode 18, each having three mutually aligned apertures 48 and 50, respectively, (only one is shown) therethrough, are attached to an opposed second major surface 52 of the ceramic support member 46, which is the sole supporting interconnection between the cathode assemblies 14, and the control grid and screen grid electrodes 16 and 18. Unlike the structure described in the aforementioned U.S. Pat. No. 4,298,818, the novel first gun module 24 further includes a pair of oppositely disposed first insulators 54 disposed along the screen grid electrode 18 and attached to the second major surface 52 of the ceramic support member 46. The first focusing and accelerating electrode 20 comprises a substantially cylindrical cup-shaped proximal electrode member 56 and a substantially cylindrical, cup-shaped distal electrode member 58. The proximal electrode member 56 is substantially closed at one end 60 and opened at the other end 62. The closed end 60 includes three proximal electrode member electron beam apertures 64 (only one of which is shown) which are aligned with the apertures 48 and 50 in the control grid and the screen grid electrodes, respectively. The closed end 60 of the proximal electrode member 56 is attached, for example by brazing, to the pair of first insulators 54 to complete the first gun module 24. Fabrication of the first gun module 24 may be facilitated by including suitable lead-frames (not shown) between the control grid and screen grid electrodes and the ceramic support-member 46 as described in a copending U.S. patent application, Ser. No. 735,261 filed on May 17, 1985 by H. E. McCandless, which is assigned to the assignee of the present invention, and which is incorporated by reference herein for the purpose of disclosure.

Figure 5:
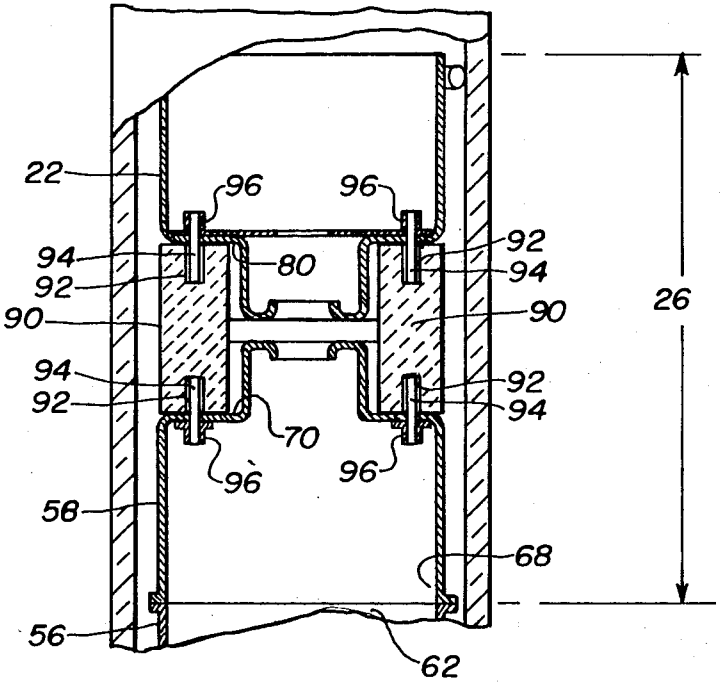
FIG. 5 shows a partial side sectional view of a second embodiment of the present invention.

The second gun module 26 includes the distal electrode member 58 of the first focusing and accelerating electrode 20 and the second focusing and accelerating electrode 22. The distal electrode member 58 is substantially cylindrical and cup-shaped being substantially closed at one end 66 and open at oppositely disposed end 68. The closed end 66 of the member 58 has a distal electrode support portion 70 lying in a first plane A and a distal electrode base portion 72 laying in a second plane B which is parallel to and spaced from the first plane A. Three inline distal electrode member apertures 74 (only one of which is shown) are formed through the base portion 72 of the member 58. The second focusing and accelerating electrode 22 is substantially cylindrical and cup-shaped. The electrode 22 is closed at one end 76 and open at the other end 78. The closed end 76 of the electrode 22 has a support portion 80, lying in a third plane C, and a base portion 82, lying in a fourth plane D, which is parallel to and spaced from the second plane C. Three inline second electrode apertures 84 (only one of which is shown) are substantially aligned with the apertures 74 in the distal electrode member 58. A shield member 86 is disposed within and attached to the inside surface of the support portion 80. The shield member 86 has three inline apertures 88 therethrough (only one of which is shown) which are aligned with the apertures in the previous electrodes to facilitate passage of the electron beams from the cathode assemblies 14. The distal electrode member 58 and the second focusing and accelerating electrode 22 are oriented so that the respective closed ends 66 and 76 are facing one another and spaced apart. A pair of insulative spacers 90 are secured between the facing support portions 70 and 80 of the distal electrode member 58 and the second focusing and accelerating electrode 22 and laterally spaced from the apertures 74 and 84, respectively. The insulative spacers 90 preferably comprise a ceramic material such as steatite; however, glass or a similar material, which is capable of standing-off a voltage differences of at least 25 to 30 kV between the distal electrode member 58 and the second focusing and accelerating electrode 22 may be used. If the spacers 90 comprise a ceramic material, they may be attached by brazing to the support portions 70 and 80. The brazing may be accomplished by using a suitable brazing fixture which aligns the apertures 74 and 84 or which aligns the outside surfaces of the distal electrode member 58, the spacers 90 and the second focusing and accelerating electrode 22, as is known in the art. Alternatively, as shown in FIG. 5, the insulative spacers 90 may have a cavity 92 formed in each end thereof. A metal pin 94 is bonded into each cavity 92, for example by a glass frit (not shown). The pins 94 extend through openings (not shown) in the support portion 70 of the distal electrode member 58 and in the support portion 80 of the second focusing and accelerating electrode 22. A plurality of eyelets 96 attached to the support portions 70 and 80 accommodate the pins 94 which are secured therein, for example by welding. The final fabrication step in each of the embodiments shown in FIGS. 3 and 5 is to align the electron beam apertures of the first and second gun modules and to join, for example by welding together the two open ends 62 and 68 of the proximal and distal electrode members 56 and 58, respectively to form the electron gun 10.

GENERAL CONSIDERATIONS

Figure 4:
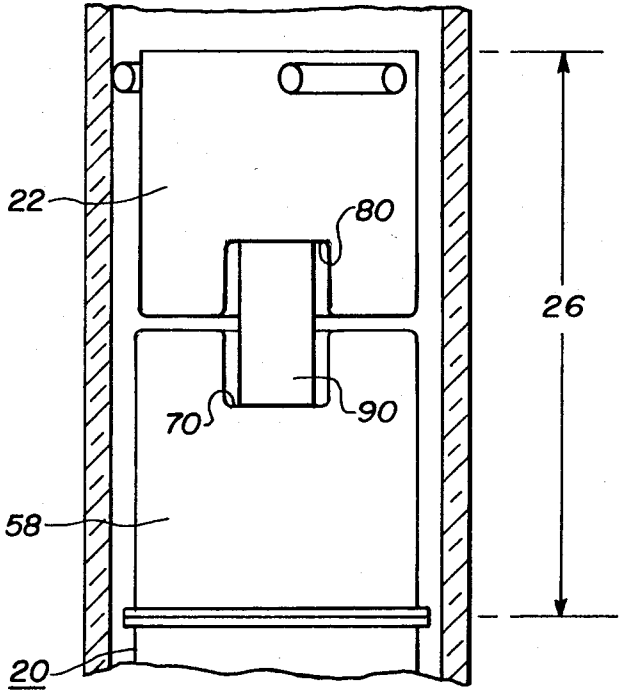
FIG. 4 shows a partial front view of the novel electron gun within the neck of a CRT taken along line 4—4 of FIG. 3.

The use of two separately fabricated gun modules permits the first gun module 24 to be constructed to meet the precision alignment and high operating temperature requirements of the beam-forming region of the electron gun. The second gun module 26 has a less stringent requirement for electrode alignment; however, the electrical performance requirements, e.g. freedom from stray electron emission and electrical breakdown, are more stringent than in the first gun module 24 because the electrodes of the second gun module 26 operate at a focus voltage of about 7 kV and an anode voltage about 25 kV, respectively. It has been found that the cylindrical shape of the first and second focusing and accelerating electrodes 20 and 22 seems to substantially eliminate arcing in the vicinity of the first focusing and accelerating (G3) electrode 20 thereby reducing electrical breakdown which can cascade through the beam-forming region as described in U.S. Pat. No. 4,491,764 issued to D'Amato on Jan. 1, 1985. The novel configuration of the second gun module 26 shown in FIGS. 3 and 4, wherein the insulative spacers 90 are attached to recessed support portions 70 and 80 of the distal electrode member 58 and the second focusing and accelerating electrode 22, effectively shields portions of the spacers 90 during spot-knocking of the electron gun in the manufacturing operation. Since it is known that spot-knocking evaporates metal for the more negative electrode which is normally the first focusing and accelerating (G3) electrode 20, and deposits this metal on the spacers 90, the area of deposition is limited to the portion of the spacers 90 adjacent to the gap between the distal electrode member 58 and the second focusing and accelerating electrode 22. Accordingly, only a small portion of spacers 90 have metal evaporated thereon and the portions of the spacers 90 adjacent to member 58 and electrode 22 are sufficiently shielded by being recessed so that electrical breakdown (arcing) across the spacers 90 generally does not occur.

What is claimed is:

1. An electron gun for a cathode-ray tube including, in combination, a first gun module comprising at least one cathode assembly, a control grid electrode, a screen grid electrode and a proximal member of a first focusing and accelerating electrode, each of said electrodes of said first gun module having at least one electron beam aperture therethrough, said cathode assembly and said electrodes being attached to a ceramic support member which is the sole supporting interconnection between, and a second gun module comprising a second focusing and accelerating electrode and a distal member of said first focusing and accelerating electrode, each of said electrodes of said second gun module having at least one electron beam aperture therethrough, said distal member and said second focusing and accelerating electrode being interconnected by at least two insulative spacers disposed and attached therebetween, said distal member of said first focusing and accelerating electrode of said second gun module being joined to said proximal member of said first focusing and accelerating electrode of said first gun module so that said electron beam apertures of said first and said second gun modules are aligned, thereby forming said electron gun.

2. A multi-beam electron gun for a cathode-ray tube including, in combination, a first gun module comprising a plurality of cathode assemblies, a control grid electrode, a screen grid electrode and a proximal member of a first focusing and accelerating electrode, each of said electrodes of said first gun module having a plurality of electron beam apertures therethrough, said cathode assemblies being attached to one surface of a ceramic support member and said control grid electrode, said screen grid electrode and said proximal member of said first focusing and accelerating electrode being attached to an opposite surface of said ceramic support member which is the sole supporting interconnection therebetween, and a second gun module comprising a second focusing and accelerating electrode and a distal member of said first focusing and accelerating electrode, each of said electrodes of said second gun module having a plurality of electron beam apertures therethrough, said distal member and said second focusing and accelerating electrode being interconnected by at least two insulative spacers disposed and attached therebetween, said distal member of said first focusing and accelerating electrode of said second gun module being joined to said proximal member of said first focusing and accelerating electrode of said first gun module so that said electron beam apertures of said first and second gun modules are aligned, thereby forming said electron gun.

3. The multi-beam electron gun as described in claim 2 wherein said first and second focusing and accelerating electrodes comprise substantially cylindrical members, said distal electrode member of said first focusing and accelerating member being substantially closed at one end and open at the other end, said substantially closed end having said apertures therethrough, said second focusing and accelerating electrode being substantially closed at one end and open at the other end, said substantially closed end having said apertures therethrough, said closed end of said distal electrode member facing said closed end of said second focusing and accelerating electrode and being spaced therefrom by said two insulative spacers.

4. The multi-beam electron gun described in claim 3, wherein each of the closed ends of said distal electrode member and of said second focusing and accelerating electrode has a support portion lying in a first plane and a base portion lying in a second plane, said apertures being formed in said base portion.

5. The multi-beam electron gun as described in claim 4, wherein said two insulative spacers are laterally spaced from said apertures.

6. The multi-beam electron gun as described in claim 5, wherein said two insulative spacers are attached to said support portions of said distal electrode member and said second focusing and accelerating electrode.

7. A method of manufacturing a cathode-ray tube electron gun comprising at least one cathode assembly and at least four successive electrodes longitudinally spaced from said cathode assembly, each of said electrodes having at least one electron beam aperture therethrough, said cathode assembly and said electrodes being attached to a plurality of insulative support members, the steps including attaching said cathode assembly to one surface of a first insulative support member, attaching two of said at least four successive electrodes and a first portion of a third electrode to an opposite surface of said first insulative support member to form a first gun module, attaching a second portion of said third electrode and a fourth electrode to oppositely disposed surfaces of a pair of insulative support members to form a second gun module, and attaching together said first and second portions of said third electrode to join said first gun module and said second gun module.

* * * * *